US006564943B2

(12) United States Patent
Barton et al.

(10) Patent No.: US 6,564,943 B2
(45) Date of Patent: May 20, 2003

(54) CONTAINER FOR WELDING WIRE

(75) Inventors: David J. Barton, Twinsburg, OH (US); Lisa M. Byall, Rocky River, OH (US); James T. Land, Concord Township, OH (US); Herbert H. Matthews, III, Willoughby Hills, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 81 days.

(21) Appl. No.: 09/904,140

(22) Filed: Jul. 13, 2001

(65) Prior Publication Data

US 2003/0010663 A1 Jan. 16, 2003

(51) Int. Cl.[7] ..... B65D 85/04

(52) U.S. Cl. ..... 206/395; 206/397; 206/408; 206/586; 206/594; 229/122.33; 242/170

(58) Field of Search ..... 206/389, 395–397, 206/408, 409, 586, 594; 220/62.2, 651–653; 229/122.33, 918; 242/160.4, 170, 171

(56) References Cited

U.S. PATENT DOCUMENTS 1,640,368 A 8/1927 Obetz et al.
3,086,689 A * 4/1963 Wiedenmeier ..... 206/586
3,244,347 A * 4/1966 Jenk ..... 206/586
3,648,920 A 3/1972 Stump
4,122,949 A * 10/1978 Blatt ..... 206/408
4,623,063 A * 11/1986 Balkin ..... 206/408
5,494,160 A 2/1996 Gelmetti

FOREIGN PATENT DOCUMENTS

EP 1 057 751 A1 12/2000

OTHER PUBLICATIONS

Brochure entitled "*The Squaring of the Circle*"; C.I.F.E., s.p.a; Italy; publication date unknown.
Brochure entitled "*Weld Point Robotic Welding Wire—Technology of the Future*"; Sidergas S.R.L.; Italy; publication date unknown.

* cited by examiner

*Primary Examiner*—Jim Foster
(74) *Attorney, Agent, or Firm*—Fay, Sharpe, Fagan, Minnich & McKee

(57) ABSTRACT

A container for packaging and unwinding a welding wire comprising: a square cardboard box with four vertical side walls and four vertically extending corners, each defining an apex, a center cylindrical core, an inner vertically extending tubular liner with an octagonal outer shape having four outer walls, each generally overlying a side wall of the box and four alternate inner walls between two of the outer walls and spaced from the corner apexes to define generally triangular, vertical cavities with an at rest dimension from the apex of a corner to one of the alternate inner walls and a vertically extending corner reinforcing element in each of the cavities. The element in each cavity has a diagonal pressure rib extending from the apex to the inner wall.

30 Claims, 6 Drawing Sheets

CONTAINER FOR WELDING WIRE

The present invention relates to a cardboard container or box for packaging and unwinding coiled welding wire.

INCORPORATION BY REFERENCE

In recent times, a substantial industry has been developed around providing coils of electric welding wire in square cardboard boxes. This new technology is described in Gelmetti U.S. Pat. No. 5,494,160 and Cipriani EPC Application No. 1,057,751 A1. This patent and published application are incorporated by reference herein to illustrate the use of cardboard boxes with center cores to package and allow unwinding of coiled welding wire. It is common also to provide a center octagonal liner, as shown in the EPC application to define spaced triangular corner cavities each filled with a tubular reinforcing element. Such tubular elements are shown in Obetz U.S. Pat. No. 1,640,368 and Stump U.S. Pat. No. 3,648,920. These patents disclosing corner reinforcing elements for cardboard boxes are incorporated by reference as background information regarding the use of corner tubular support members or elements. Tubular support members are also shown in brochures entitled "The Squaring of the Circle" and "Weld Point Robotic Welding Wire—Technology of the Future". These printed publications are incorporated by reference herein to illustrate reinforced corners in square boxes, some of which include an octagonal inner lining against which the welding wire is pushed during the coiling operation. All of these prior patents and publications are incorporated by reference as background to the present invention.

BACKGROUND OF THE INVENTION

The prior art discussed above illustrates the development of square cardboard boxes for packaging and unwinding of welding wire, wherein the cardboard boxes are modified by a variety of structural elements to solve the many and diverse problems experienced by use of cardboard boxes. Using the background technology relating to cardboard boxes for welding wire, it has been determined that the best results are accomplished using a square box having an octagonal center lining and an inner core around which the wire is coiled. This basic box construction allows the wire to be coiled around the center core so it fills the space between the center core and the inner lining. By using the inner lining, the wire actually engages eight different surfaces to restrict its outer dimension and confine its radial spread during coiling, shipping, and unwinding. The unique combination of a square cardboard box and an octagonal center lining around an inner core produces four triangular cavities at the corners of the cardboard box. In accordance with standard technology, these four triangular cavities are filled by vertical reinforcing elements in the form of tubes or triangles generally matching the cavities. Such reinforcing elements increase vertical ridigity of the box, thus allowing shipment of several stacked boxes. Selection of a cardboard box with a center lining and reinforcing corner elements satisfies several diverse needs and solves problems associated with the recent trend toward the use of cardboard boxes for welding wire. Advantageous features from several box structures are thus obtained in a single container. However, the prior box technology with or without a liner required restriction of the coiled wire. Otherwise, there was deformation of the square cardboard box forming the package. As shown in Gelmetti U.S. Pat. No. 5,494,160, the coil is maintained in the center of the box by spaced diagonal wood strips. The Gelmetti box does not include a center octagonal liner. Consequently, when using the advantageous combination of a square box and a center octagonal liner, the coil tended to expand against the side walls of the box, causing the box to assume a non-square, generally circular configuration, especially after long shipping and storage times. For this reason, the advantageous combination of the octagonal liner in a square box with corner reinforcing has been used primarily with a structure to control the outward movement of the coil such as ties, as shown in the prior publication entitled "The Squaring of the Circle".

The present invention overcomes difficulties experienced in prior attempts to employ the superior concept of a square cardboard box with an octagonal inner liner and corner reinforcing elements. In the past, the coil around the center core would engage the four side walls of the box to bow the box outwardly and effect the appearance and use of the cardboard box. Solving this problem by tying the wire coil merely reduced the amount of wire that could be loaded into the box. The invention involves an improvement in the basic design, which improvement overcomes the tendency of the box to bow out without reducing the capacity of the box constraining the wire coil.

In accordance with the invention, the well known corner reinforcing elements are modified to create an integral pressure rib extending from the apex of a corner toward the diagonal wall of the center liner. This rib, in the preferred embodiment, is wide enough to force the diagonal wall to bow outwardly. When wire is coiled about the core and engages the four diagonal side walls of the inner liner, the pressure rib extending from the apex of the corners is engaged and creates a line of force from the wire coil directly to the vertical apex at all four corners of the cardboard box. In this manner, the corners are placed in tension to counteract the tendency of the side walls to bow outwardly when the liner is engaged by the wire coiled around the center core. By merely forming the corner support elements to include an integral, diagonally extending pressure rib, the box maintains its square configuration even during shipping and long storage. Consequently, the hat or adapter used at the welding operation to affix a wire conduit above the center of the box easily fits over the box. In the past, the hat had to reshape the cardboard box into a square. In some instances, this presented difficulty. By merely modifying the center reinforcing tubes to provide a pressure rib between the liner and the apex of each corner, a loaded box is placed in tension and the square shape is maintained. This change in the corner structure of the container allows the advantages known to exist by using a square container with an octagonal center liner. The coil does not need to be restrained, and the box does not experience undue distortion. There is no need to sacrifice the advantage of a center liner so the wire coil can be maintained in a center position as in the Gelmetti patent. The capacity of the container is maximized, while still rigidifying its shape.

In accordance with the present invention, there is provided a container for packaging and unwinding a welding wire. The container comprises a square cardboard box with four vertical walls and four vertically extending corners, each defining an apex. There is a center cylindrical core and an inner, vertically extending tubular liner with an octagonal shape defined by four outer walls, each generally overlying the side wall of the box, and four alternate inner walls between two of the outer walls and spaced from the corner apexes to define generally triangular vertical cavities. The box has an at rest dimension from the apex of the corner to the inner walls of the liner. The container is provided with standard vertically extending corner reinforcing element in each of the triangular corner cavities. In accordance with the invention, the reinforcing element of each cavity has a diagonally extending pressure rib extending from the apex of the corner to the inner wall of the liner. The width of this pressure rib is greater than the at rest dimension of the corner cavity. Consequently, the rib pushes the wall inwardly. A coil of welding wire around the core presses on the inner wall to apply a force along the apex of the box corner. This places the corners of the box in tension to counteract the tendency of the wire to bow the sides of the box into the shape of the coiled wire. In accordance with an aspect of the invention, the pressure rib is formed integrally with the vertical reinforcing element. Preferably, the element is formed from folded cardboard. After the container is used, all parts of the box can be recycled as used cardboard. In accordance with a broader aspect of the invention, the rib does not bow the liner wall inwardly, but is used to prevent outward bowing of the liner wall. Any tendency to bow outwardly engages the pressure rib, forcing the rib against the corner to rigidify the box and maintain its squareness.

The primary object of the present invention is the provision of a container for packaging and unwinding welding wire, which container utilizes the concept of a square cardboard box with a center octagonal liner while overcoming the tendency for the box to deform during shipment, storage, and use.

A further object of the present invention is the provision of a container, as defined above, which container is only a minor modification of existing containers and involves a low expense while obtaining the desired results of maintaining box squareness.

Still a further object of the present invention is the provision of a square cardboard box having a center octagonal cardboard liner with a modified corner reinforcing element that has a pressure rib extending from the apex of four box corners to the liner in the box so that filling of the box does not change its square configuration.

These and other objects and advantages will become apparent from the following description taken together with the accompanying drawings.

PREFERRED EMBODIMENT

Figure 1:
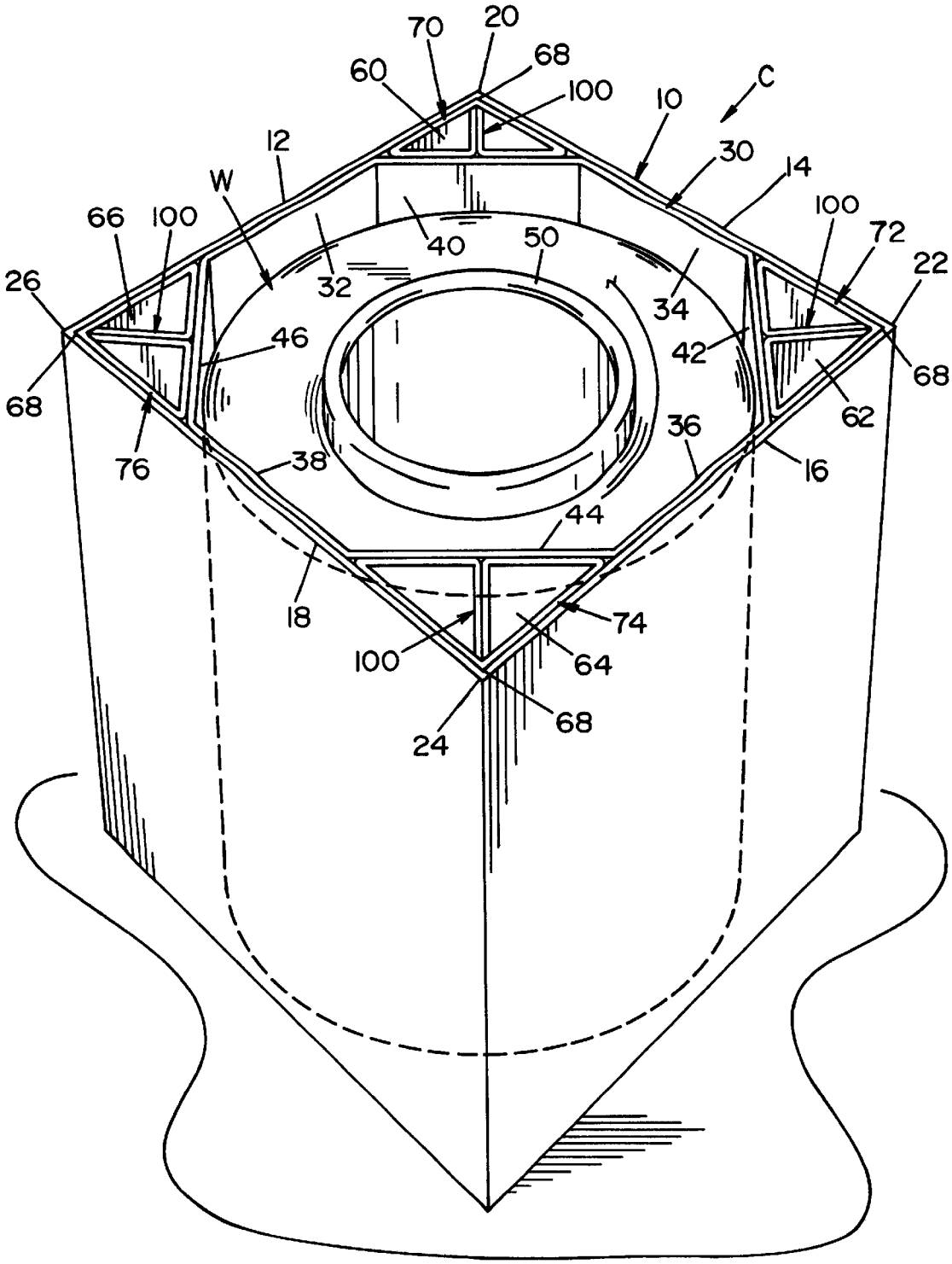
FIG. 1 is a top pictorial view illustrating the preferred embodiment of the present invention.
Figure 2:
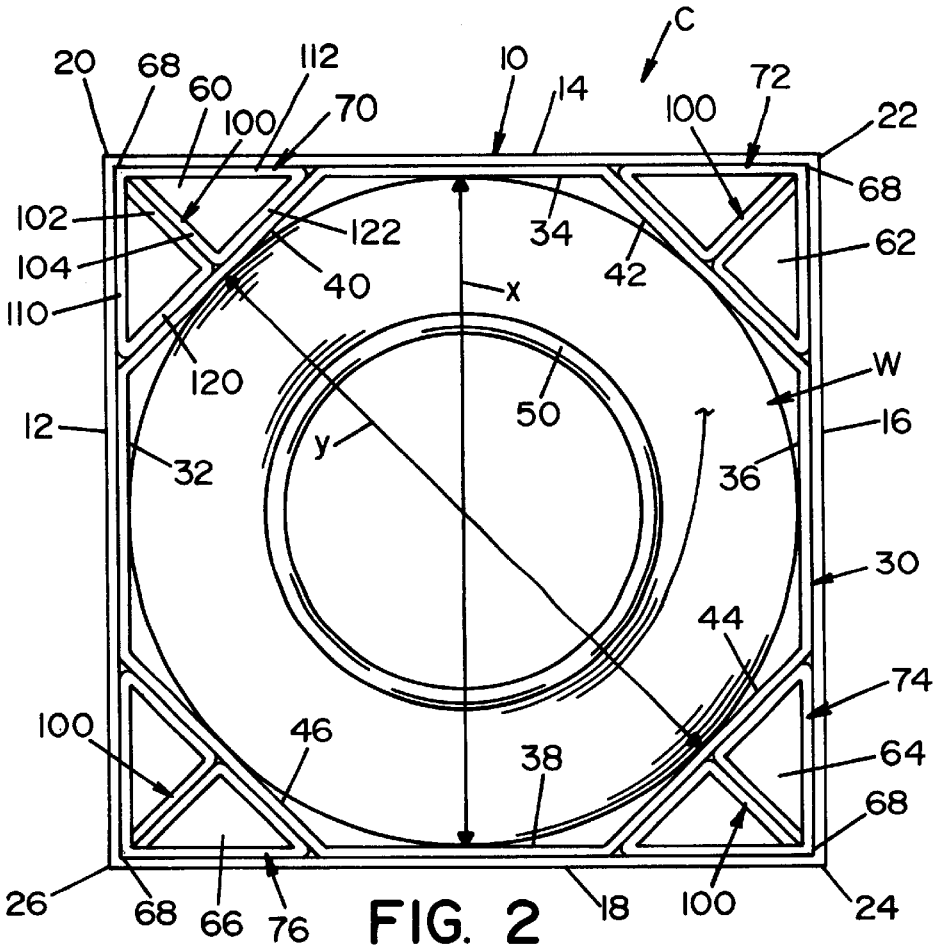
FIG. 2 is a top plan view of the container shown in FIG. 1.

Referring now to the drawings wherein the showings are for the purpose of illustrating a preferred embodiment of the invention only and not for the purpose of limiting same, FIGS. 1 and 2 show a container C in the form of a square cardboard box 10 with outer side walls 12, 14, 16, and 18. The side walls define four corners 20, 22, 24, and 26. To support wire within box 10, an octagonal liner 30, also formed from cardboard, is provided with outer walls, 32, 34, 36, and 38 lying against side walls 12, 14, 16, and 18, respectively. At the corners of the box, liner 30 includes inner diagonally extending walls 40, 42, 44, and 46. These diagonal walls form four corner cavities 60, 62, 64, and 66, each of which has an outer apex 68. Welding wire W is coiled around center core 50 to engage the inner and outer walls of liner 30, as shown in FIGS. 1 and 2. Triangular corner cavities 60–66 receive triangular cardboard reinforcing elements 70, 72, 74, and 76 to provide vertical rigidity to container C. As so far described, container C is standard and is constructed as an optimum type of square cardboard container for shipping and unwinding welding wire W.

Figure 3:
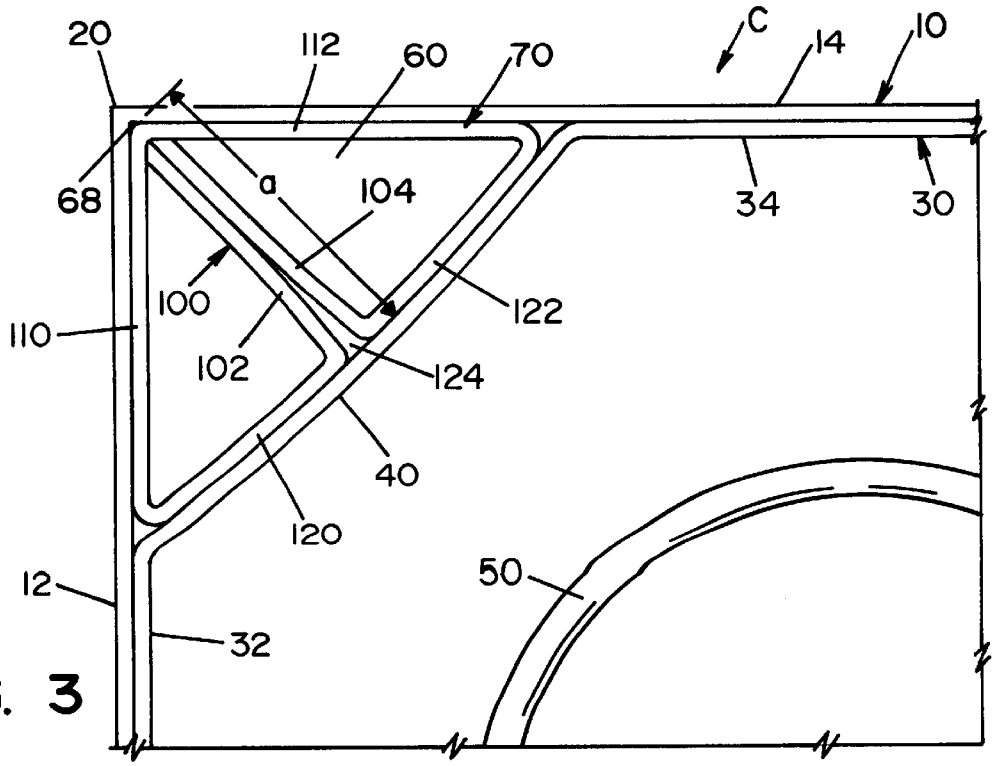
FIG. 3 is an enlarged partial top plan view showing the corner of a container having a reinforcing element constructed in accordance with the preferred embodiment of the invention.
Figure 4:
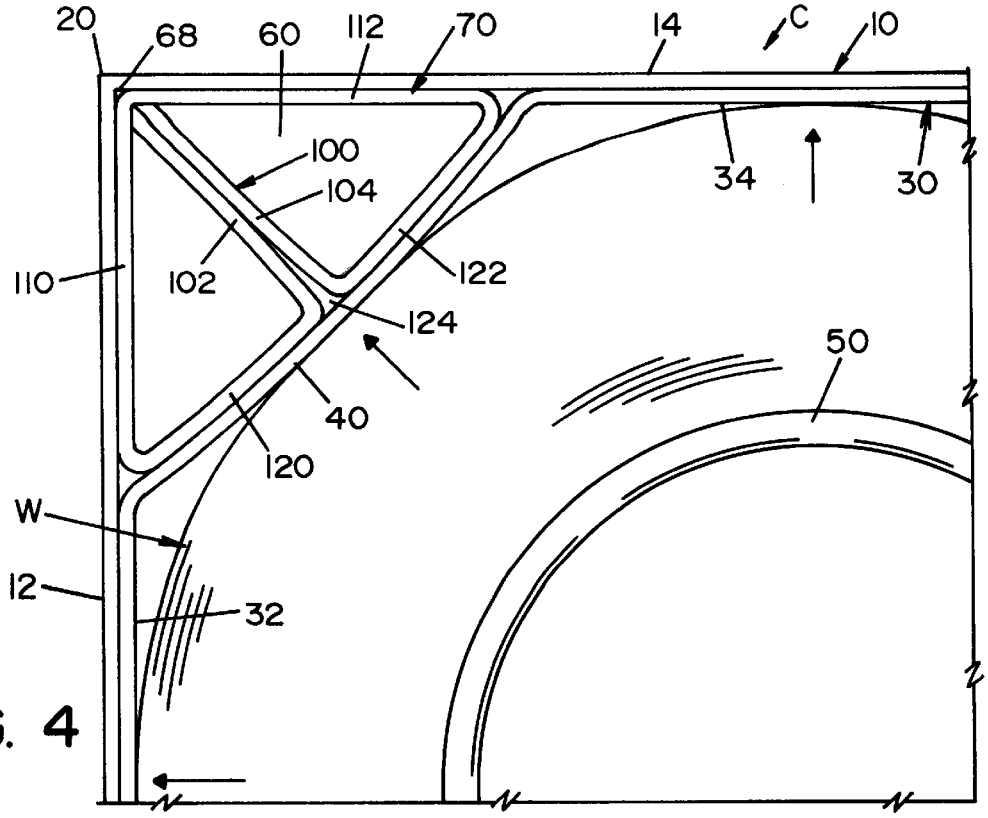
FIGS. 4 and 5 are partial, enlarged top plan views similar to FIG. 3 showing functional characteristics of the preferred embodiment of the present invention.
Figure 5:
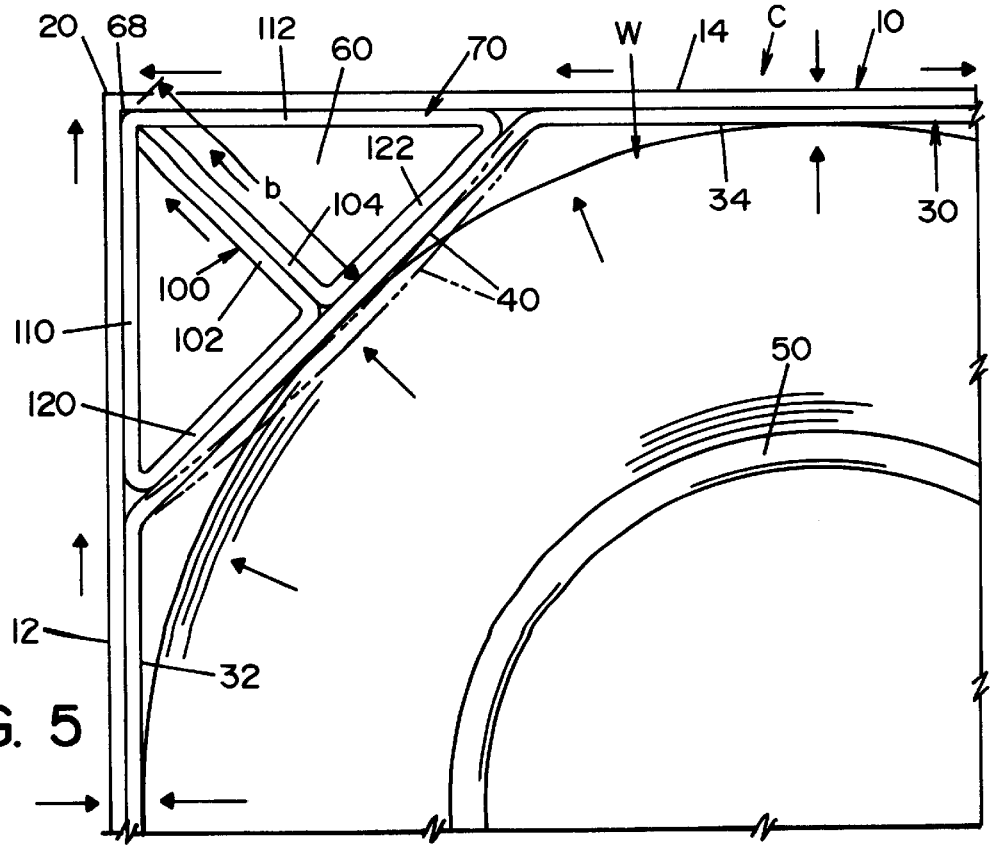

In accordance with the invention, the corner elements 70–76 are modified to include a central pressure rib 100 extending from apex 68 of each corner cavity 60–66. As shown in FIGS. 3–5, the preferred embodiment of rib 100 involves a single piece of cardboard folded in a triangular configuration to define two layers 102, 104 constituting rib 100. The cardboard triangular element 70, shown in FIGS. 3–5, is the same as element 72–76 and will be described only once, with this description applying to all corner elements. The single folded cardboard element 70 includes partitions 110, 112 extending from apex 68 along side walls 12, 14, respectively. Flat wall portions 120, 122 extend from the end of partitions 110, 112, respectively, to the center rib defining layers 102, 104. By this structure, layers 102, 104 defining rib 100 are captured within the diagonal portion of element 70 to produce a rigid force transmitting member between inner wall 40 and apex 68 of corner 20. FIG. 3 illustrates the initial position or configuration of element 70 in cavity 60. The effective width a of rib 100 is greater than the at rest position of inner wall 40. Thus, the wall bows slightly inwardly as shown in FIG. 3. In this initial position, layers 102, 104 are slightly separated at gap 124. This initial position is shown in solid lines in FIG. 4 and in phantom lines in FIG. 5. When wire W is coiled around core 50 to load container C, the wire expands outwardly in liner 30 to fill the liner. This is an advantage of a center liner. As wire fills the liner, the wire flows outwardly against the walls of liner 30. Each of the diagonal walls at the corners of the box are, thus, forced outwardly as shown in FIG. 5. The diagonal distance x at the sides, as shown in FIG. 2, is generally equal to the diagonal distance y across the corners after the box is loaded. However, when empty, the distance x is substantially greater than the distance y. This allows for the outward force during coiling of the welding wire into box or container C. Outward movement of wall 40 caused by the wire shifts wall 40 into its normal at rest position closing gap 124 and forcing rib 100 into the apex 68. This causes tension at the corners as indicated by the arrows in FIG. 5. As the loading of the wire continues, wall 40 assumes the position shown in FIG. 5, forcing rib 100 into apex 68. This maintains the squareness of the box by rigidifying corner 20. Thus, force of the coil against side walls 32–38 does not cause box 10 to assume a generally round configuration. The distance b is the at rest position of wall 40 and is less than the initial width a of rib 100 as shown in FIG. 3. By using modified corner element 70, the corners of box 10 are rigidified and the box is maintained square. This allows the use of the center liner 30 in a square box with the advantageous features of this box construction.

Figure 6:
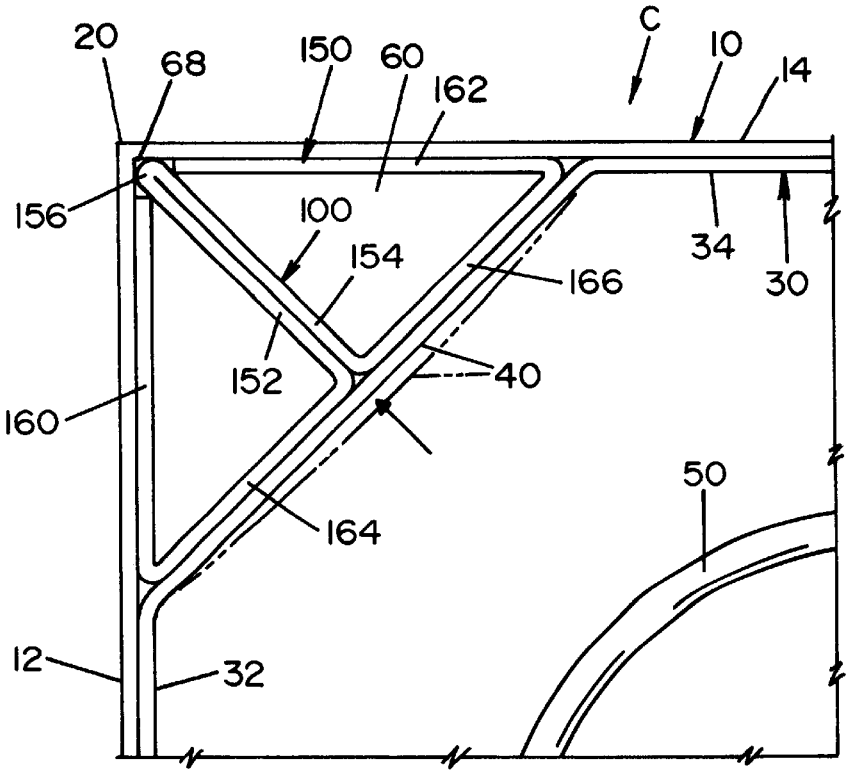
FIGS. 6–9 are views like FIGS. 3–5 showing modifications of the corner element to illustrate preferred alternative embodiments of the present invention; and, FIGS. 10 and 11 are partial top plan views of asymmetric corner elements using the invention.
Figure 7:
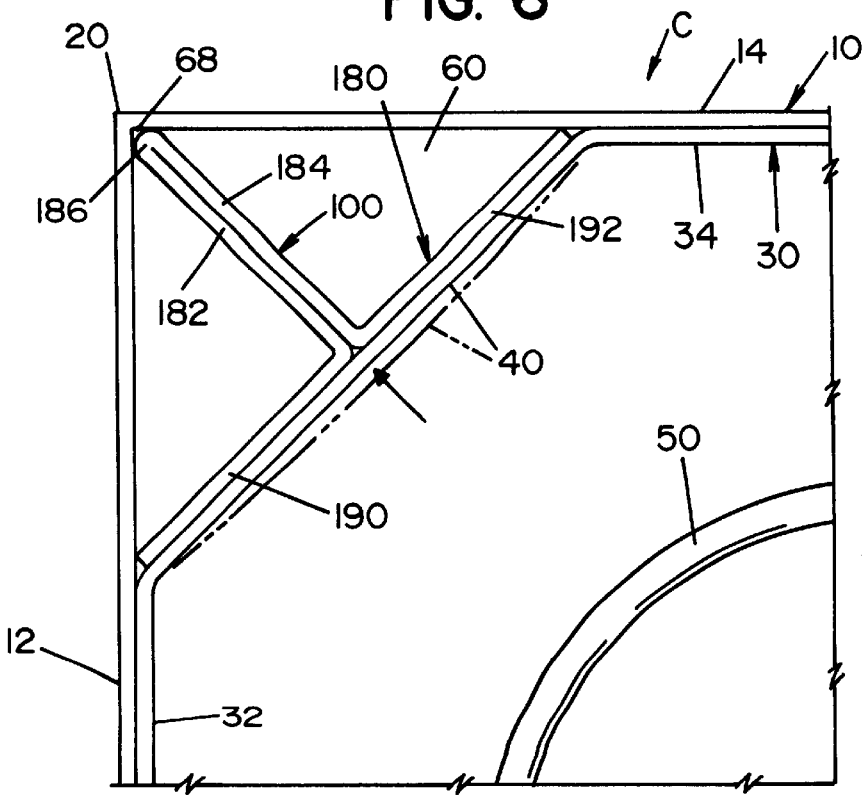

To provide pressure to rib 100 by folding the cardboard forming the corner reinforcing element 70, a variety of cardboard or plastic configurations have been used. A modification is shown in FIG. 6, wherein corner element 150 is a single piece of cardboard forming rib 100 in two layers 152, 154 joined at outer fold 156 engaging apex 68. Partitions 160, 162 are joined by wall partitions 164, 166 with layers 152, 154 to complete the corner element 150. As shown, wall 40 has the phantom line position until wire W, not shown, is loaded into the container. Then, the wall moves toward the solid line position and presses rib 100 into apex 68 to rigidify corner 20. When it is not necessary to provide as much vertical rigidity to container C, the corner elements can be reduced in size, so long as pressure rib 100 is maintained. Such a less strong corner element 180 is shown in FIG. 7, wherein pressure rib 100 is formed by two layers 182, 184 joined at fold 186, similar to fold 156 in FIG. 6. Only wall portions 190, 192 are provided on element 180 so the partitions 160, 162 of FIG. 6 are eliminated. Corner element 180 provides a lesser amount of vertical rigidity; however, it still obtains the advantage of the present invention, with rib 100 between wall 40 and apex 68. As the wire is coiled into the container, wall 40 moves outwardly compressing rib 100 against apex 68 to thereby rigidify corner 20. Wall portions 190, 192 capture element 180 in the corner cavity.

Figure 8:
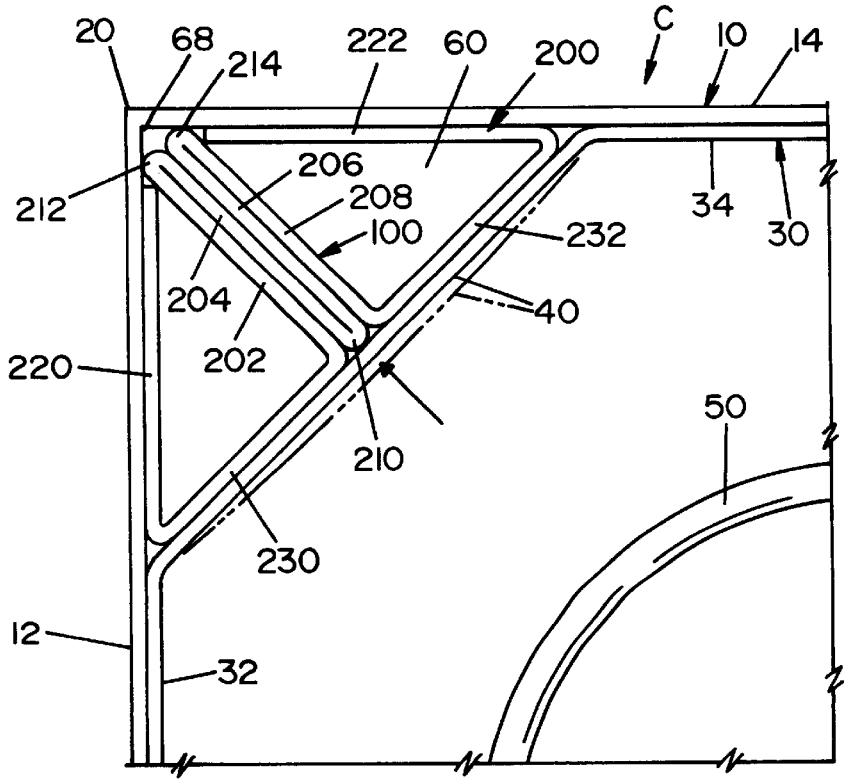
Figure 9:
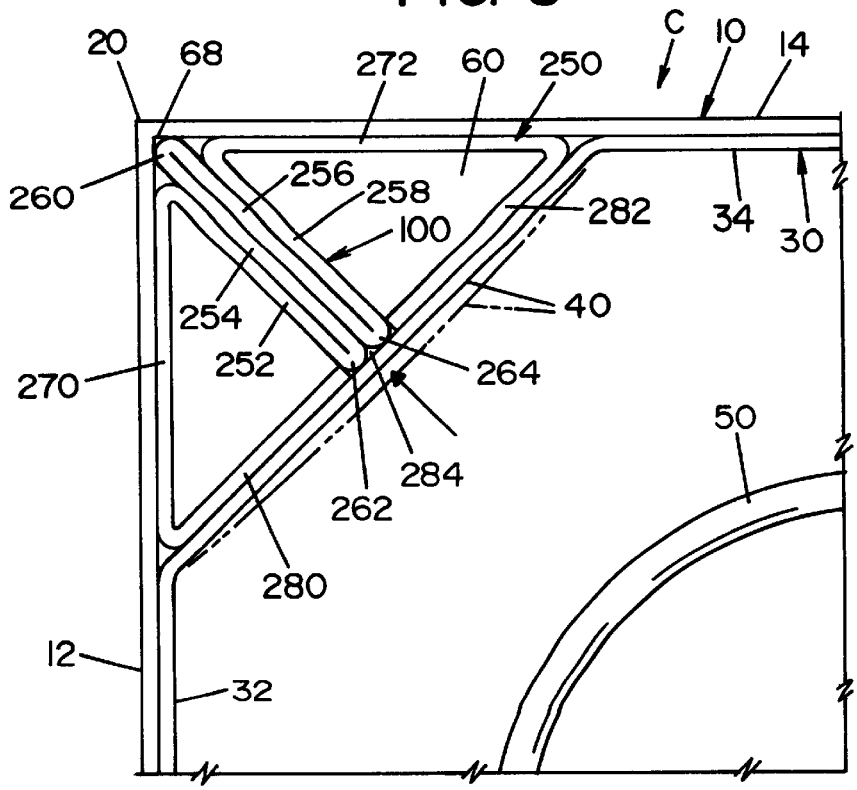

The rigidity of diagonal pressure rib 100, in accordance with another aspect of the invention, can be increased by increasing the number of layers forming the rib. This concept is shown in FIGS. 8 and 9. Triangularly shaped corner reinforcing element 200 shown in FIG. 8 forms rib 100 using four layers 202, 204, 206, and 208 joined together by folds 210, 212, and 214. Otherwise, element 200 is essentially the same as previously described element. It includes partitions 220, 222 extending along walls 12, 14, respectively. To join rib 100 with these partitions, wall portions 230, 232 are provided in the single piece of plastic or cardboard forming reinforcing element 200. In a like manner, rib 100 of element 250 in FIG. 9 includes four layers of cardboard or plastic 252, 254, 256, and 258. This modification of the invention is different from the modification shown in FIG. 8 by reversing the positions of folds 260, 262, and 264. Fold 260 is at apex 68 and folds 262, 264 are at liner wall 40. Partitions 270, 272 extend from the apex 68 and are joined to wall portions 280, 282 extending along wall 40 and providing a gap 284 to accommodate folds 262, 264. Wall portions 280, 282 of element 250 could move inwardly from wall 40 without departing from the intended spirit and scope of the invention; however, in practice, they are held in place by the folds. As an alternative, the edges of these wall portions are adhered to the area of rib 100 adjacent folds 262, 264.

Figure 10:
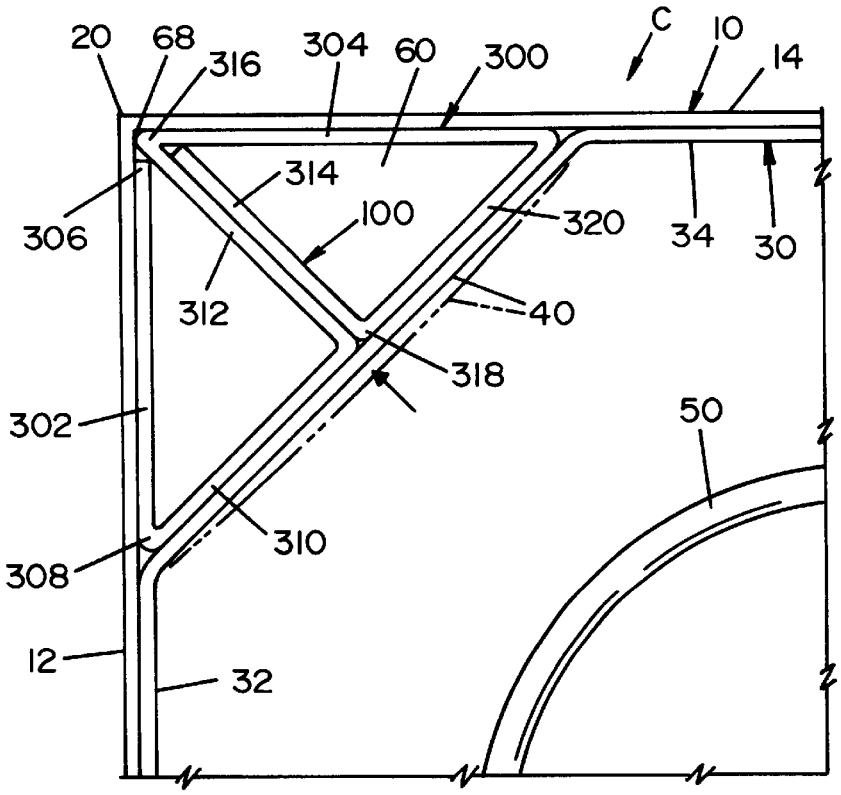
Figure 11:
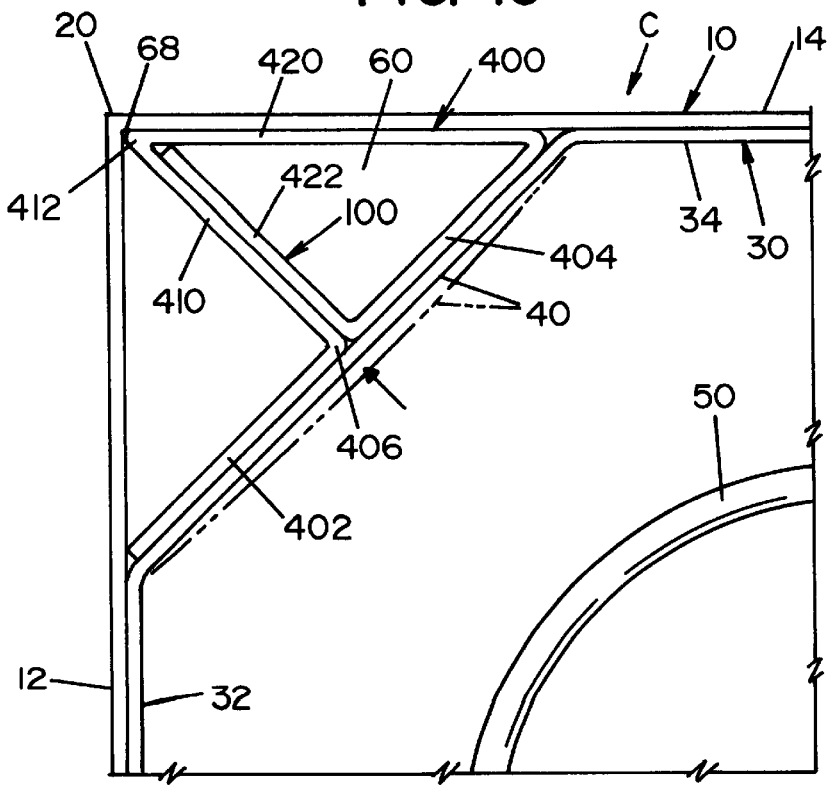

Corner elements 70, 150, 180, 200, and 250 are generally symmetrical; however, this is only a preferred configuration. Asymmetrically formed corner elements 300 and 400 in cavity 60 provide pressure rib 100 between apex 68 and lever wall 40 as shown in FIGS. 10 and 11. Element 300 shown in FIG. 10 has partitions 302, 304 against side walls 12, 14. End 306 of partition 302 is the starting point of the single cardboard structure. At its end 308, partition 302 is joined to wall portion 310 terminating as one layer 312 of rib 100. A second layer 314 extends from folded corner 316 at the apex end of partition 304 to end 318 at wall portion 320 extending along wall 40 to the opposite end of partition 304. This fold pattern provides two layers for rib 100 and holds the rib perpendicular to wall 40 and into apex 68. Element 400 shown in FIG. 11 is also an asymmetric folded element. Wall portions 402, 404 are held in general contact with liner wall 40. At end 406 of portion 402 one layer 410 of rib 100 extends to apex 68. At the upper end of layer 410 is folded corner 412 connected to one end of the single partition 420. The other end of this corner partition is connected to the distal end of wall 404 extending to layer 422 of rib 100. Again, the asymmetrical folded corner reinforcing element in cavity 60 provides two layers for rib 100 and holds the rib perpendicular to wall 40.

Other modifications of the corner reinforcing element to produce the desired diagonally extending rib 100 could be provided. The corner reinforcing element can be formed from more than one piece of cardboard. In practice, the rib 100 forces wall 40 inward until wire W is coiled into container C. In some situations, rib 100 has a lesser width; however, outward movement of diagonal walls 40–46 pushes the rigidified pressure rib into the box corners to place the corners in tension to reduce the tendency of the box to become round. Container C does not require restraint of the wire or spacing of the wire inward from the square box, as in Gelmetti U.S. Pat. No. 5,494,160.

Having thus described the invention, it is claimed:

1. A container for packaging and unwinding a welding wire, said container comprising: a square cardboard box with four vertical side walls and four vertically extending corners, each defining an apex, a center cylindrical core, an inner vertically extending tubular liner with an octagonal outer shape having four outer walls, each generally overlying a side wall of said box and four alternate inner walls between two of said outer walls and spaced from said corner apexes to define generally triangular, vertical cavities with an at rest dimension from the apex of a corner to one of said alternate inner walls and a vertically extending corner reinforcing element in each of said cavities, said element of each cavity having a diagonal pressure rib extending from said apex to the inner wall defining one of said corner cavities and with a width greater than said at rest dimension of said cavity whereby a coil of welding wire around said core presses on said alternate inner wall of a corner cavity to apply an outer force along said apex of said box corner cavity.

2. A container as defined in claim 1, wherein said core is a paper board tube.

3. A container as defined in claim 2, wherein said pressure rib is integral with said vertical reinforcing element.

4. A container as defined in claim 1, wherein said pressure rib is integral with said vertical reinforcing element.

5. A container as defined in claim 1, wherein said vertical corner reinforcing element is a single piece of cardboard folded into a shape having two partitions lying along two of said side walls and extending from said apex, each of said partitions converging into a flat wall overlying a portion of one of said inner walls of said liner and meeting in the general center of said inner wall and said rib being an extension of at least one of said flat walls of said cardboard piece and extending from the center of said inner wall to said apex of said corner.

6. A container as defined in claim 5, wherein said rib is an extension of both of said flat walls of said cardboard piece and extending from the center of said inner wall to said apex of said corner as a two-layer structure.

7. A container as defined in claim 1, wherein said vertical reinforcing element comprises multiple pieces of cardboard.

8. A container as defined in claim 7, wherein said pressure rib is integral with said vertical reinforcing element.

9. A container for packaging and unwinding a welding wire, said container comprising: a square cardboard box with four side walls and four vertically extending corners, each defining an apex, an inner vertically extending tubular liner with an octagonal outer shape having four outer walls each generally overlying a side wall of said box and four alternate inner walls between two of said outer walls and spaced from said corner apexes to define generally triangular, vertical cavities with an at rest dimension from the apex of a corner to one of said alternate inner walls and a vertically extending pressure rib extending from said apex to said inner wall of a corner cavity, said rib having a width to push said inner wall inwardly beyond said at rest dimension before said wire is coiled into said container.

10. A container as defined in claim 9, wherein said rib is a part of a cardboard triangular tube.

11. A container as defined in claim 10, wherein said rib includes at least two layers of said cardboard tube, said layers extending from said inner wall toward said apex of said corner cavity.

12. A container for packaging and unwinding a welding wire, said container comprising: a square cardboard box with four side walls and four vertically extending corners, each defining an apex, an inner vertically extending tubular liner with an octagonal outer shape having four outer walls each generally overlying a side wall of said box and four alternate inner walls between two of said outer walls and spaced from said corner apexes to define generally triangular, vertical cavities and a vertically extending pressure rib extending from said apex to said inner wall of a corner cavity, said rib having a width to push said inner wall inwardly before said wire is coiled into said container.

13. A container as defined in claim 12, wherein said rib is a part of a cardboard triangular tube.

14. A container as defined in claim 13, wherein said rib includes at least two layers of said cardboard tube, said layers extending from said inner wall toward said apex of said corner cavity.

15. A container as defined in claim 14, wherein said triangular tube is formed from at least two pieces of cardboard.

16. A container as defined in claim 13, wherein said triangular tube is formed from at least two pieces of cardboard.

17. A container for packaging and unwinding a welding wire, said container comprising: a square cardboard box with four side walls and four vertically extending corners, each defining an apex, an inner vertically extending tubular liner with an octagonal outer shape having four outer walls each generally overlying a side wall of said box and four alternate inner walls between two of said outer walls and spaced from said corner apexes to define generally triangular, vertical cavities and a vertically extending pressure rib extending from said apex to said inner wall of a corner cavity, said rib having a width to transmit force from said inner wall to said apex of said corner when said wire is coiled into said container.

18. A container as defined in claim 17, wherein said rib is a part of a cardboard triangular tube.

19. A container as defined in claim 18, wherein said rib includes at least two layers of said cardboard tube, said layers extending from said inner wall toward said apex of said corner cavity.

20. A container as defined in claim 19, wherein said triangular tube is formed from at least two pieces of cardboard.

21. A container as defined in claim 18, wherein said triangular tube is formed from at least two pieces of cardboard.

22. A container for packaging and unwinding a welding wire, said container comprising: a square cardboard box with four side walls and four vertically extending corners, each defining an apex, an inner vertically extending tubular liner with an octagonal outer shape having four outer walls each generally overlying a side wall of said box and four alternate inner walls between two of said outer walls and spaced from said corner apexes to define generally triangular, vertical cavities and a vertically extending pressure rib extending from said apex to said inner wall of a corner cavity.

23. A container as defined in claim 22, wherein said rib is a part of a cardboard triangular tube.

24. A container as defined in claim 23, wherein said rib includes at least two layers of said cardboard tube, said layers extending from said inner wall toward said apex of said corner cavity.

25. A container as defined in claim 24, wherein said rib includes more than two layers of said cardboard tube.

26. A container as defined in claim 23, wherein said rib includes more than two layers of said cardboard tube.

27. A container for packaging and unwinding a welding wire, said container comprising: a cardboard box with corners each defining an apex, an inner liner with walls extending diagonally across said corners to define generally triangular, vertical cavities and a vertically extending corner reinforcing element in each of said cavities, said element in each cavity having a pressure rib extending between said apex to said liner wall to apply a force against said corner apex as wire in said container pushes against said liner wall.

28. A container as defined in claim 27, wherein said rib is a part of a cardboard triangular tube.

29. A container as defined in claim 28, wherein said rib includes at least two layers of said cardboard tube, said layers extending from said inner wall toward said apex of said corner cavity.

30. A container as defined in claim 28, wherein said rib includes more than two layers of said cardboard tube.

* * * * *